US005956552A

United States Patent [19]

Katakabe et al.

[11] Patent Number: 5,956,552

[45] Date of Patent: Sep. 21, 1999

[54] COLOR IMAGE FORMING APPARATUS COMPRISING A REGULAR MODE AND A HIGH SPEED MODE

[75] Inventors: Noboru Katakabe, Kyoto; Hiroshi Terada; Hajime Yamamoto, both of Nara; Masanori Yoshikawa; Kenji Asakura, both of Osaka, all of Japan

[73] Assignee: Matsushita Electric Industrial Co., Ltd., Osaka, Japan

[21] Appl. No.: 09/043,549

[22] PCT Filed: Sep. 22, 1997

[86] PCT No.: PCT/JP97/03349

§ 371 Date: Mar. 19, 1998

§ 102(e) Date: Mar. 19, 1998

[87] PCT Pub. No.: WO98/13732

PCT Pub. Date: Apr. 2, 1998

[30] Foreign Application Priority Data

Sep. 24, 1996 [JP] Japan ..... 8-251920

[51] Int. Cl.[6] ..... G03G 15/01

[52] U.S. Cl. ..... 399/298; 399/223; 399/302

[58] Field of Search ..... 399/66, 298, 299, 399/302, 223, 227; 347/112, 115, 117, 118, 172, 232

[56] References Cited

U.S. PATENT DOCUMENTS

| | | | |
|---|---|---|---|
| 4,662,739 | 5/1987 | Sakai et al. | 364/142 |
| 4,743,938 | 5/1988 | Ohno | 399/227 |
| 5,255,063 | 10/1993 | Ideyama et al. | 399/301 |
| 5,325,151 | 6/1994 | Kimura et al. | 399/227 |
| 5,442,428 | 8/1995 | Takahashi et al. | 399/302 |
| 5,515,140 | 5/1996 | Atsumi et al. | 399/48 |

(List continued on next page.)

FOREIGN PATENT DOCUMENTS

| | | |
|---|---|---|
| 62-287264 | 12/1987 | Japan . |
| 63-109462 | 5/1988 | Japan . |
| 2-12271 | 1/1990 | Japan . |
| 2-311864 | 12/1990 | Japan . |
| 4-245856 | 9/1992 | Japan . |
| 4-324881 | 11/1992 | Japan . |
| 7-36246 | 2/1995 | Japan . |
| 7-84430 | 3/1995 | Japan . |
| 7-104540 | 4/1995 | Japan . |
| 8-63057 | 3/1996 | Japan . |
| 8-137171 | 5/1996 | Japan . |
| 8-314286 | 11/1996 | Japan . |

*Primary Examiner*—Sandra Brase
*Assistant Examiner*—Sophia S. Chen
*Attorney, Agent, or Firm*—Merchant & Gould P.C.

[57] ABSTRACT

In a color image forming apparatus, a plurality of image forming units 3Y, 3M, 3C and 3K, which correspond to a plurality of colors and with each unit including a developing device and a photosensitive drum, are retained so as to define a cylinder. The color image forming apparatus includes: a conveying apparatus for conveying the plurality of image forming units around the main axis of the cylinder between an image forming position and a waiting position by simultaneously rotating all image forming units; an exposing device 6 for exposure of the photosensitive drum of the image forming unit that is in the image forming position 10; a transfer apparatus 5, which contacts a transfer belt 50 with the photosensitive drum 30 of the image forming unit that is in the image forming position, and when the image forming unit that is in the image forming position is switched, successively transcribes the toner images of all colors formed on the photosensitive drums onto the transfer belt, superimposes the toner images of all colors and forms a colored toner image on the transfer belt; and a transfer belt driving apparatus for driving the transfer belt at a constant speed. When a second color image is formed after a first color image, the first toner image color of the second color image is formed on the transfer belt by using the image forming unit of the last color added to the first color image. The exposing device includes a light source accommodated by the inner portion of the cylinder defined by the image forming units.

38 Claims, 8 Drawing Sheets

U.S. PATENT DOCUMENTS

| | | | |
|---|---|---|---|
| 5,528,343 | 6/1996 | Tada et al. | 399/113 |
| 5,565,975 | 10/1996 | Kumon et al. | 399/302 |
| 5,585,911 | 12/1996 | Hattori et al. | 399/227 |
| 5,587,769 | 12/1996 | Sawada et al. | 399/113 |
| 5,587,783 | 12/1996 | Nakamura et al. | 399/301 |
| 5,610,701 | 3/1997 | Terada et al. | 399/298 |
| 5,612,771 | 3/1997 | Yamamoto et al. | 399/66 X |
| 5,666,596 | 9/1997 | Yoo | 399/111 |
| 5,669,046 | 9/1997 | Yoshida et al. | 399/167 |
| 5,787,326 | 7/1998 | Ogawa et al. | 399/124 |
| 5,809,380 | 9/1998 | Katakabe et al. | 399/227 |

COLOR IMAGE FORMING APPARATUS COMPRISING A REGULAR MODE AND A HIGH SPEED MODE

FIELD OF THE INVENTION

The present invention relates to a color image forming apparatus used in a color printer, a color copying machine or a color facsimile. More specifically, the present invention relates to acceleration and miniaturization of a color image forming apparatus that forms a color toner image by superimposing toner images of various colors using electrophotography.

BACKGROUND OF THE INVENTION

As a prior art example of such a color image forming apparatus, an outline of the structure of the color printer described in Publication of Unexamined Patent Application (Tokkai) No. Hei 7-36246 is explained. As can be seen in FIG. 8, which shows the internal structure viewed from the side, this apparatus comprises an intermediate transfer belt unit 201 including a transfer belt 202, a primary transfer roller 203, a secondary transfer roller 204, a cleaner roller 205, and a waste toner reservoir 206. Composition of color toner images is performed on the transfer belt 202.

Four image forming units 207Bk, 207Y, 207M and 207C for black, yellow, magenta and cyan, each unit being of sector shape in cross section, are arranged circularly in the middle of the printer to form a group of image forming units 208. When an image forming unit 207Bk, 207Y, 207M or 207C is set properly in the printer, mechanical and electrical connection systems are established between one of the image forming units 207Bk, 207Y, 207M and 207C and the machine body side via mutual coupling members, so that both sides are mechanically and electrically connected.

The image forming units 207Bk, 207Y, 207M and 207C are supported by a supporter, which can revolve around a cylindrical shaft 209, and are collectively rotated by a motor. Each image forming unit is successively moved by rotation to an image forming position 210, where it opposes the primary transfer roller 203 spanning the intermediate transfer belt 202. The image forming position 210 is also the exposure position for exposure by a laser beam 211.

Numeral 212 is a laser exposing device arranged in the lower part of the printer. The laser signal beam 211 passes through a light path opening 213 between the image forming units 207M and 207C, and through an opening provided in the cylindrical shaft 209, and enters a mirror 214, which is positioned inside the shaft 209 and fixed directly to the machine body. The laser beam 211 reflected by the mirror 214 enters the image forming unit 207Bk located at the image forming position 210 through an exposure opening 215, and passes through an exposure space between a developing device 216 and a cleaner 217, arranged on the upper and the lower side in the image forming unit, and enters an exposure portion on the left side of the photosensitive drum 218. The laser signal beam is scanned by the exposing device along the direction of the axis of the photosensitive drum 218 and a latent image is formed. The toner image is formed on the surface of the photosensitive drum 218 by development with the developing device 216.

The toner image formed on the photosensitive drum 218 is transferred to the intermediate transfer belt 202. Then, the group of image forming units 208 rotates by 90 degrees, so that the yellow image forming unit 207Y moves to the image forming position 210. An operation similar to the operation explained above for the formation of the black image is performed to form a yellow toner image overlaying the black toner image that has already been formed on the intermediate transfer belt 202. Similar operations as explained above are performed using the magenta and cyan image forming units to compose a fall color image on the intermediate transfer belt 202. This full color image is further transferred onto a recording paper by a secondary transfer roller 219, and after the image on the paper is fixed by a fixing device 220, the paper is ejected.

When the image formation of one sheet is finished, the group of image forming units 208 rotates another 90 degrees, so that the black image forming unit 207Bk returns to the image forming position 210 and can engage in the next image formation.

As is described above, in an image forming device employing a conventional rotation type group of image forming units, the operation of switching the image forming units is performed four times per image formation on one sheet. A certain time is required each time the image forming unit is switched. Namely, a switching time is necessary until the exposure with the next color can begin, which encompasses the time to rotate the group of image forming units for 90 degrees, the time needed to release and couple the driving couplers between the photosensitive drum in the image forming position and the main body driving side, the time until the photosensitive drum starts to rotate and the rotation speed is stabilized, and the time until the revolving photosensitive drum is charged to a constant level.

For the output speed per sheet, this switching time is clearly not short when it comes to multiple output of consecutive sheets and becomes a big obstacle to the acceleration of color image forming apparatus.

Moreover, in a conventional color image forming apparatus, the laser exposing device is arranged outside the group of image forming units and the laser signal beam is reflected from the mirror arranged in the middle of the group of image forming units to expose the photosensitive drum in the image forming position. With such a structure, the light path from the laser exposing device to the photosensitive drum can easily become long, so that high dimensional accuracy for the optical parts constituting the laser exposing device is necessary. Moreover, the optical system of the laser exposing device is separated into laser light source and mirror, so that it cannot be optically adjusted as a single element. Therefore, an adjustment after assembly is arduous and it is difficult to ensure the scanning precision. Moreover, for reasons of miniaturization and economy, it is desirable to make the toner capacity that can be accommodated in the image forming units as large as possible and the entire apparatus as small as possible.

Under consideration of the problems of the prior art, it is a purpose of the present invention to provide a color image forming apparatus that can perform faster image formation in the case of consecutive output of multiple pages, but whose assembly and adjustment of the apparatus is easy and which enhances miniaturization.

SUMMARY OF THE INVENTION

A first structure of a color image forming apparatus according to the present invention comprises: a plurality of image forming units, which correspond to a plurality of colors and comprise a developing device and a photosensitive drum, retained so as to define a cylinder; a conveying means for conveying the plurality of image forming units around the main axis of the cylinder between an image forming position and a waiting position by simultaneously rotating all image forming units; an exposing device for exposure of the photosensitive drum of the image forming unit that is in the image forming position; a transfer means, which contacts a transfer belt with the photosensitive drum of the image forming unit that is in the image forming position, and when the image forming unit that is in the image forming position is switched, successively transcribes the toner images of all colors formed on the photosensitive drums onto the transfer belt, superimposes the toner images of all colors and forms a colored toner image on the transfer belt; and a transfer belt driving means for driving the transfer belt at a constant speed; and is characterized in that when a second color image is formed after a first color image, the first toner image color of the second color image is formed on the transfer belt by using the image forming unit of the last color added to the first color image.

With such a structure, in the case that a color image is formed by superimposing for example four toner images, the number of times that the image forming unit has to be switched per page for consecutive output is three times, and thus once less than the four times that were hitherto necessary. Due to the reduction of the switching times, the time needed for example for the movement of the image forming units and the coupling between the photosensitive drum and the main body side driving mechanism, corresponding to one switching time, can be saved, so that the recording speed for consecutive output can be increased.

In the above color image forming apparatus, it is preferable that the transfer belt is an intermediate transfer belt transferring the color toner image as a whole onto recording paper. It is also preferable that during the formation of one color image, each time a toner image of one color is formed, the transfer belt driving means stops the transfer belt and the conveying means switches the image forming unit while the intermediate transfer belt is stopped, but when moving from the formation of the first color image to the second color image, the transfer belt driving means continues to rotate the intermediate transfer belt and the formation of the second color image begins, while the conveying means is still retaining the image forming unit in the image forming position.

In conventional apparatus, the color image was formed by always superimposing the colors in the same order, but in the apparatus according to the present invention, the order of color superimposition changes each time. When the order of color superimposition changes, the coloring of the output color image can differ a little bit. This difference usually poses no problem, but it is possible that small differences in the coloring of each page become a problem in the case of multiple output of the same image.

Therefore, it is preferable to employ a regular mode, wherein, when the second color image is formed successively after formation of the first color image, the colors of the toner image are superimposed on the transfer belt in the same order as in the first color image by switching the image forming unit in the image forming position, and a high speed mode, wherein the toner image of the first color of the second color image is formed on the transfer belt by using the image forming unit of the last color that was superimposed in the first color image. By doing so, it is possible to perform image formation in a conventional manner with the same order of color superimposition every time by selecting the regular mode in the case that uniform coloring of each page is preferred, or to select the high-speed mode in the case that a high-speed consecutive output is preferred.

It is preferable that for the formation of the colors of the toner image, one from a plurality of stored process conditions is selected according to the order of color superimposition and executed. As process conditions, it is possible to change for example the charge voltage of the photosensitive drum or the developing bias. By doing so, the density of each toner image to be formed on the photosensitive drum can be adjusted, and variations of the coloring, which changes a little according to the order of color superimposition, can be compensated.

It is preferable to employ a regular color mode using the four colors yellow, magenta, cyan and black for formation of a color image, and a three-color mode using the three colors yellow, magenta and cyan for formation of a color image. Especially in the case of a color image with little black content, it is possible to accelerate the output even further, in addition to the reduction of the number of times the image forming unit has to be switched as described above, by selecting a three-color mode wherein the color image is formed using only the three colors yellow, magenta and cyan.

A first structure of a color image forming apparatus according to the present invention comprises: a plurality of image forming units, which correspond to a plurality of colors and comprise a developing device and a photosensitive drum, arranged so as to define a cylinder; a conveying means for conveying the plurality of image forming units around the main axis of the cylinder between an image forming position and a waiting position by simultaneously rotating all image forming units; an exposing device for exposure of the photosensitive drum of the image forming unit that is in the image forming position; a transfer means, which contacts a transfer belt with the photosensitive drum of the image forming unit that is in the image forming position, and when the image forming unit that is in the image forming position is switched, successively transcribes the toner images of all colors formed on the photosensitive drums onto the transfer belt, superimposes the toner images of all colors and forms a colored toner image on the transfer belt, and a transfer belt driving means for driving the transfer belt at a constant speed; and is characterized in that the exposing device comprising a light source is accommodated by the inner portion of the cylinder defined by the plurality of image forming units.

According to the above structure, the exposing device including the light source, for example a laser exposing device comprising a laser light source and an optical scanning system, can be integrated into one unit. As a result, the optical system can be adjusted with one single unit, so that assembly and adjustment of the optical system can be performed easily and with high precision. Moreover, the cylinder defined by the image forming units contains the exposing device, so that empty space can be utilized efficiently to contribute to the miniaturization of the entire apparatus.

It is preferable that the exposing device is supported by plates on both sides of the device's main body opposing both ends of the cylinder, and the exposing device can be attached and removed in a substantially vertical direction from one of these plates. With such a structure, the exposing means can be installed alone into the apparatus main body and removed from the apparatus main body, without removing parts such as the conveyor means, which retains and rotates the image forming units, so that the maintenance of the apparatus is facilitated.

It is preferable that the color image forming apparatus comprises a positioning means for positioning both ends of the photosensitive drum in the image forming position, the exposing device and the positioning means being supported by plates on both sides of the device's main body opposing both ends of the cylinder. With such a structure, the relative position of the photosensitive drum of the image forming unit in the image forming position and the exposing device can be regulated precisely.

It is preferable that the conveying means comprises a carriage, which maintains the plurality of image forming units and is rotatably supported by the device's main body, and a carriage driving mechanism for rotating the carriage. Because the position of the image forming units can be switched simultaneously just by rotating the carriage, the structure of the entire apparatus is simplified.

It is preferable that the image forming units comprise a photosensitive drum, a developing device for developing a latent image formed on the surface of the photosensitive drum, a toner hopper containing toner, a cleaner for removal of waste toner that remained on the surface of the photosensitive drum, a waste toner case for collection of waste toner that has been removed by the cleaner, wherein, in two adjacent image forming units retained by the carriage, the toner hopper of one image forming unit and the waste toner case of the other image forming unit are separated by a small spacing and face each other. With such a structure, the space having a donut-shaped cross section, wherein the image forming units are retained by the carriage means, can be utilized efficiently and without waste, which contributes to the miniaturization of the entire apparatus.

DESCRIPTION OF THE PREFERRED EMBODIMENTS

The preferred embodiments of the present invention are explained below with reference to the drawings. First of all, FIG. 1 illustrates the internal structure in a side view of a color image forming apparatus according to an embodiment of the present invention; the structure and operation of all parts are explained in order.

(Image Forming Units)

Figure 1:
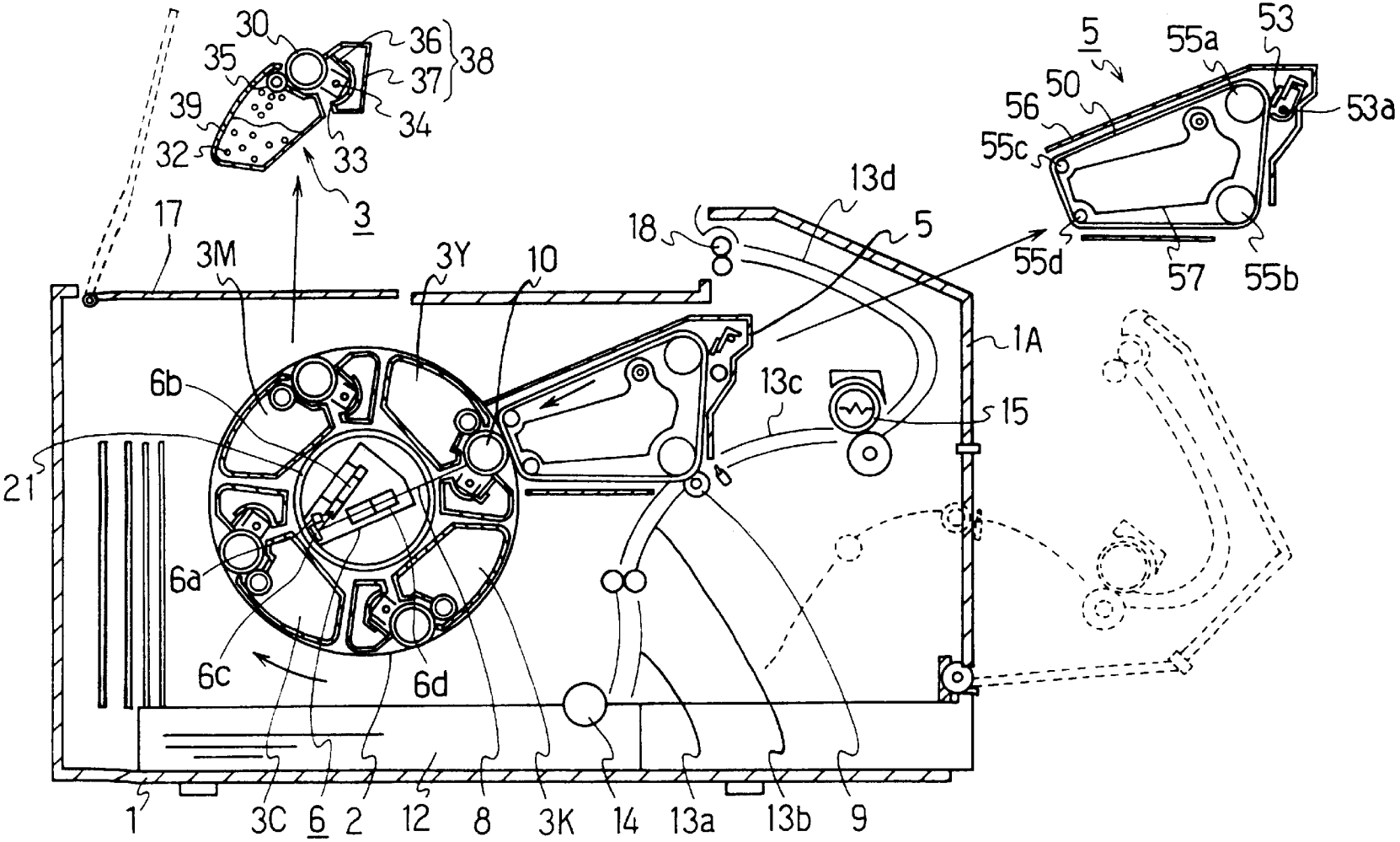
FIG. 1 is an exploded cross section showing the entire structure of an embodiment of the color image forming apparatus according to the present invention.

In FIG. 1, image forming units 3 are provided for the colors yellow, magenta, cyan and black. The image forming units are integrated devices comprising a photosensitive drum 30 and peripheral process elements, each image forming unit comprising the following parts: a corona charger 34 that charges the photosensitive drum 30 evenly with a negative voltage, a developing device 35 having a developing roller, and a toner hopper 39. The toner hopper 39 contains a toner 32 that can be negatively charged and is made of polyester resin and pigment dispersed in the resin. The toner 32 is carried by the surface of the developing roller of the developing device 35 to develop the photosensitive drum 30. A cleaner 38 provides for cleaning remaining toner on the surface of the photosensitive drum 30 after image transfer and comprises a cleaning blade 36 made of rubber and a waste toner reservoir 37 that collects waste toner. There is a light path opening 33 for a laser beam to enter the image forming unit. The photosensitive drum 30 has a diameter of 30 millimeters. The developing roller of the developing device 35 has a diameter of about 16 millimeters. The photosensitive drum 30 and the developing roller are rotatably mounted on side walls of the image forming unit 3.

(Transfer Belt Unit)

A transfer belt unit 5 is provided for receiving a toner image formed on the photosensitive drum 30 at an image forming position 10 and reforming the toner image on a recording paper sheet. The transfer belt unit 5 comprises integrated members such as an intermediate transfer belt 50, a group of guide pulleys 55*a*–55*d* for supporting the belt 50, a cleaner (cleaning blade) 53 and a waste toner container 57 for collecting waste toner after cleaning. The transfer belt unit 5 is attached removably in one piece to the machine body 1.

The intermediate transfer belt 50 has an overall film thickness of 100–300 micron and comprises a urethane base of a semiconducting (medium electrical resistance) endless belt with a thickness of approximately 100 micron and a surface layer made of a fluororesin such as polytetrafluoroethylene (PTFE) or a copolymer of tetrafluoroethylene and perfluoroalkylvinylether (PFA). The perimeter of the intermediate transfer belt 50 is 378 millimeters, which corresponds to the length of A4 paper size (297 millimeters) plus half the perimeter of the photosensitive drum (30 mm diameter) plus some small allowance, so that A4 size and letter size paper sheets can be used for full color printing.

The guide pulley 55*a* of the intermediate transfer belt serves as a driving pulley for the intermediate transfer belt and as a backup roller for the cleaning blade 53. The guide pulley 55*b* serves as a backup roller for the secondary transfer roller 9 for transferring a toner image from the intermediate transfer belt 50 onto a recording paper sheet. The guide pulley 55*c* applies a primary transfer bias for transferring a toner image from the photosensitive drum 30 to the intermediate transfer belt 50. The guide pulley 55*d* serves as a tension pulley for applying a tension to the intermediate transfer belt 50. The intermediate transfer belt 50 is put over these guide pulleys and rotates in accordance with the rotation of the driving pulley 55*a*. The intermediate transfer belt 50 is protected by a cover 56.

(Carriage)

As shown in FIG. 1, a carriage 2 is employed in the center portion of the machine body 1. In the front side of the machine body (on the right side of FIG. 1), there is a front alligator opening 1A, and there is a top door 17 on the top of the machine body.

The carriage 2 carries four color image forming units 3Y, 3M, 3C, and 3Bk. The carriage 2 is rotatably mounted on the machine body 1 so as to rotate around the axis of a cylindrical shaft 21. Thus, the photosensitive drum 30 of each image forming unit can be rotated between the image forming position 10 and waiting positions.

By opening the top door 17, the image forming unit 3 can be taken by its handle (not shown in the drawing) and easily removed from the carriage 2. Therefore, if one of the image forming units 3 needs to be replaced, it can be replaced with a new unit by rotating the carriage 2 so that the image forming unit 3 is located directly under the top door 17, and opening the door 17.

Each color image forming unit 3 operates only when it is located at the image forming position 10, where its photosensitive drum 30 is irradiated by the laser beam 8 and in contact with the transfer belt unit 5. Therefore, in the image forming position 10, the image forming unit 3 is connected mechanically to the drive mechanism and electrically to a power source or other device of the machine body 1. In the waiting positions, the image forming unit 3 does not operate.

Figure 2:
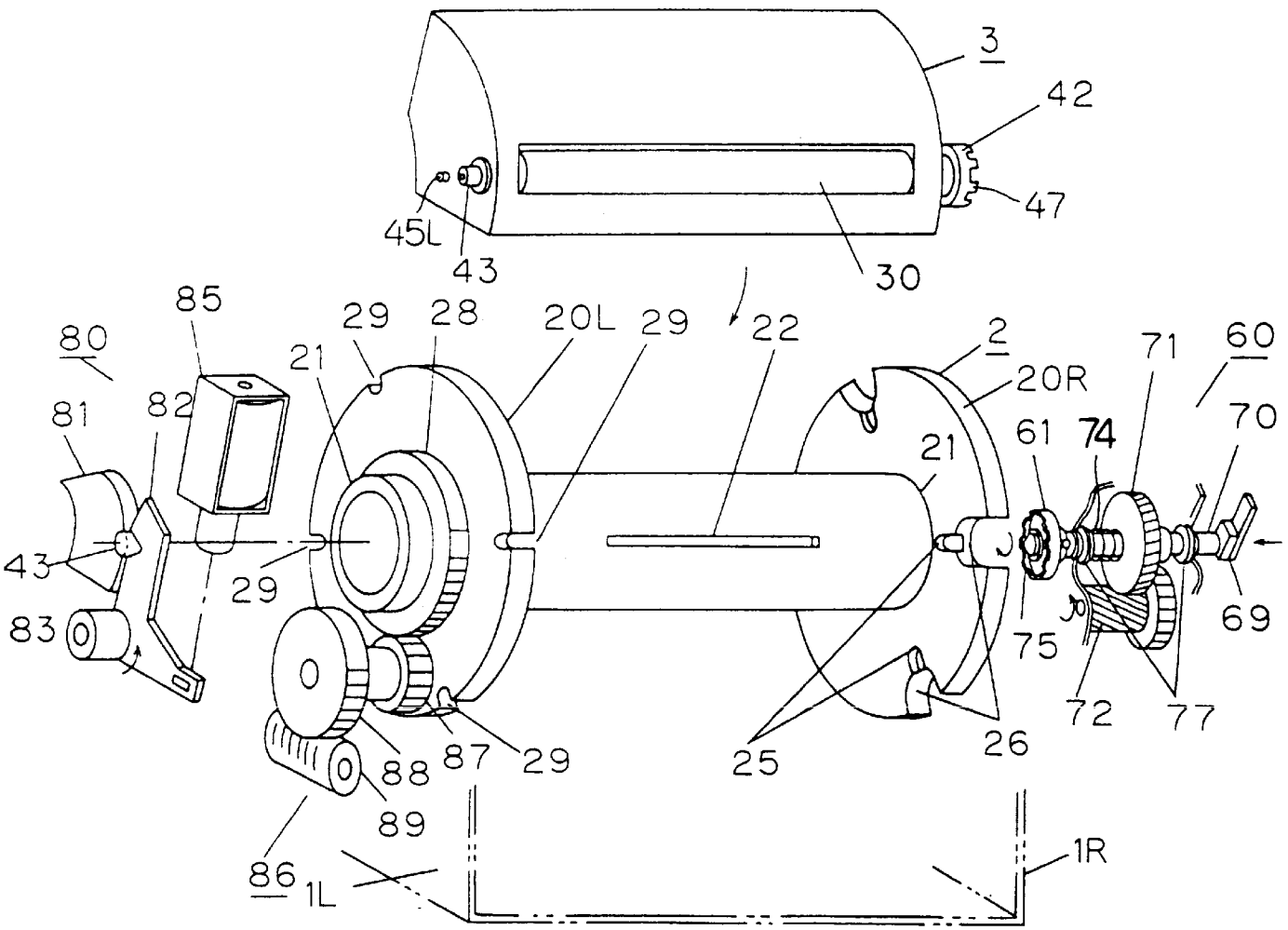
FIG. 2 is an exploded perspective view showing the positioning and driving mechanism for carriage and photosensitive drum in the color image forming apparatus of FIG. 1.

As can be seen in FIG. 2, the carriage 2 has a right wall 20R and a left wall 20L, which are fixed to the central cylindrical shaft 21. The cylindrical shaft 21 has four openings 22 through which the laser beam 8 for exposure of the photosensitive drum enters.

On the periphery of the right wall 20R, right cutouts 26 are provided for receiving a coupling plate 42 fixed to the photosensitive drum 30 of the image forming unit 3. The right cutouts 26 are bigger than the outer form of the coupling plate 42, so that the coupling plate 42 and the right wall 20R do not contact each other when the photosensitive drum is correctly positioned. On the outer periphery of the left wall 20L on the other side, left cutouts 29 are formed to receive a collar 43 that is provided at the left end of a shaft 40 of the photosensitive drum 30. The left cutouts 29 are bigger than the outer diameter of the collars 43, so that the collars 43 and the left wall 20L do not contact each other when the photosensitive drum is correctly positioned.

Guide grooves 25 are formed on the inner side of the right wall 20R and the left wall 20L to guide two guide pins 45R, 45L (only the left guide pin 45L is shown in the drawing) provided on the two sides of the image forming unit 3, which is thus positioned roughly in the carriage 2. When the image forming unit 3 is inserted in the carriage 2, the image forming unit 3 can pivot on the guide pins 45R, 45L by a clearance between the coupling plate 42 and the right cutout 26 or between the collar 43 and the left cutout 29, as is shown in FIG. 2.

When the four image forming units 3 are contained by the carriage 2, a wall of the waste toner container 37 of one image forming unit faces a wall of the toner hopper 39 of an adjacent image forming unit. With this structure, the circular space in the carriage 2 is used effectively, avoiding purposeless space. While it is not shown in detail in the drawing, there are protrusions or members on the outer perimeter of the walls 20R and 20L protruding to the inside, so that the image forming units 3 cannot fall out of the carriage 2.

Figure 3:
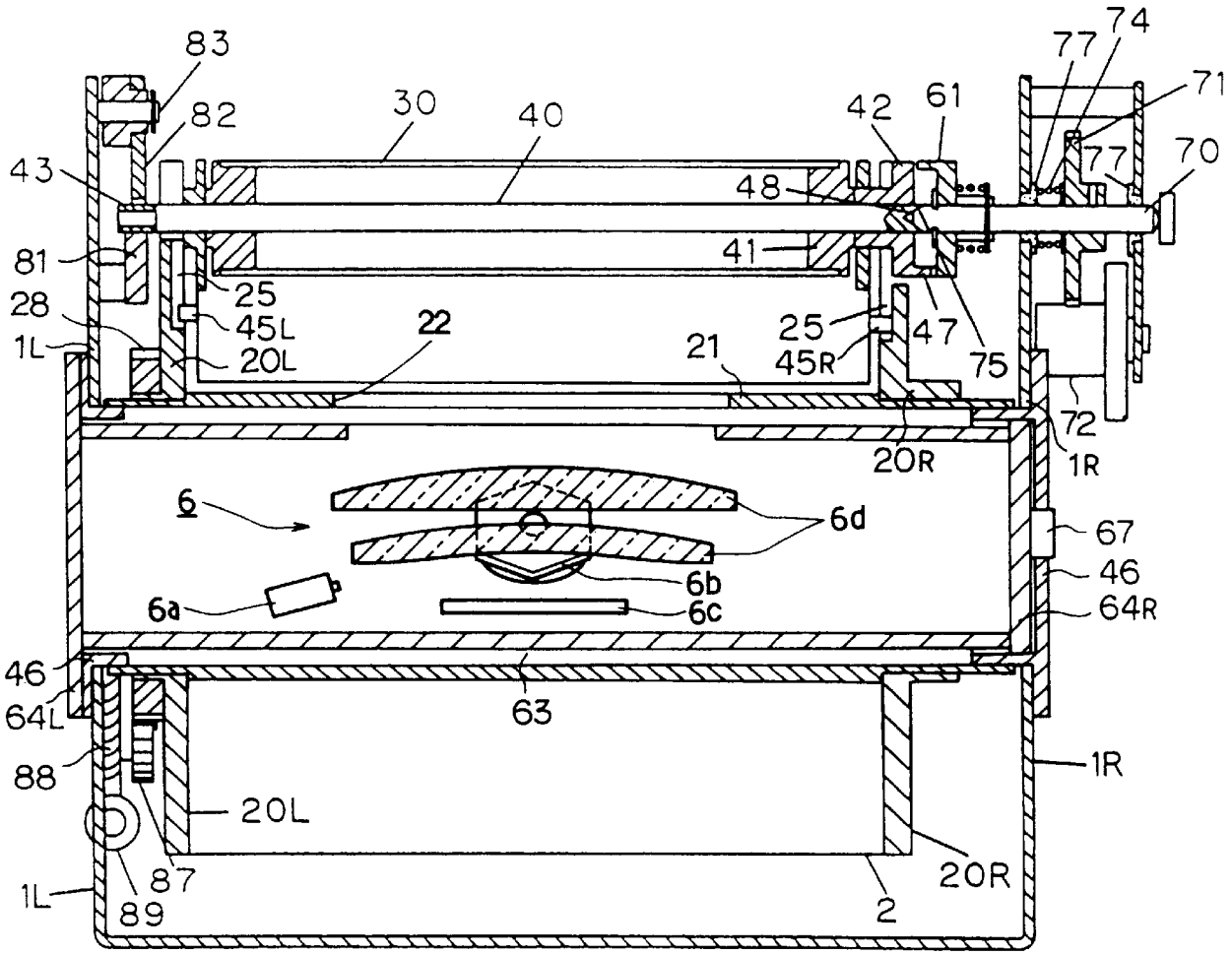
FIG. 3 is a sectional view of the carriage through the axis of the photosensitive drum of the image forming unit in the image forming position.

As shown in the perspective view in FIG. 2 and in the sectional view in FIG. 3, a carriage gear 28 is fixed to the left wall 20L and connected to a carriage driving mechanism 86 of the main body side. This carriage driving mechanism 86 includes a worm gear 89 connected to a driving power source (not shown in the drawing), a worm wheel 88 engaging the worm gear, and a gear 87, which is integrated with the worm wheel 88, engaging the carriage gear 28. The carriage 2 is rotatably supported by bearings 46 in the right and left walls of the main body 1R and 1L.

(Exposing Device)

As is shown in FIGS. 1 and 3, a laser exposing device 6 for exposure of the photosensitive drum 30 is provided in the cylindrical shaft 21 of the carriage 2. The laser exposing device 6 comprises a semiconductor laser unit 6*a* as a light source, a polygon mirror 6*b*, a mirror 6*c*, a lens 6*d* and other members. These are united to be contained in a container. A laser beam 8, which corresponds to a sequential pixel signal of an image information, is irradiated from the laser exposing device 6, passes an exposure window 22 provided in the cylindrical shaft 21 of the carriage 2, passes through the light path opening 33 formed in the image forming unit 3, irradiates the photosensitive drum 30 of the image forming unit 3 (3Y) in the image forming position 10, for a scan in the axial direction.

Figure 4:
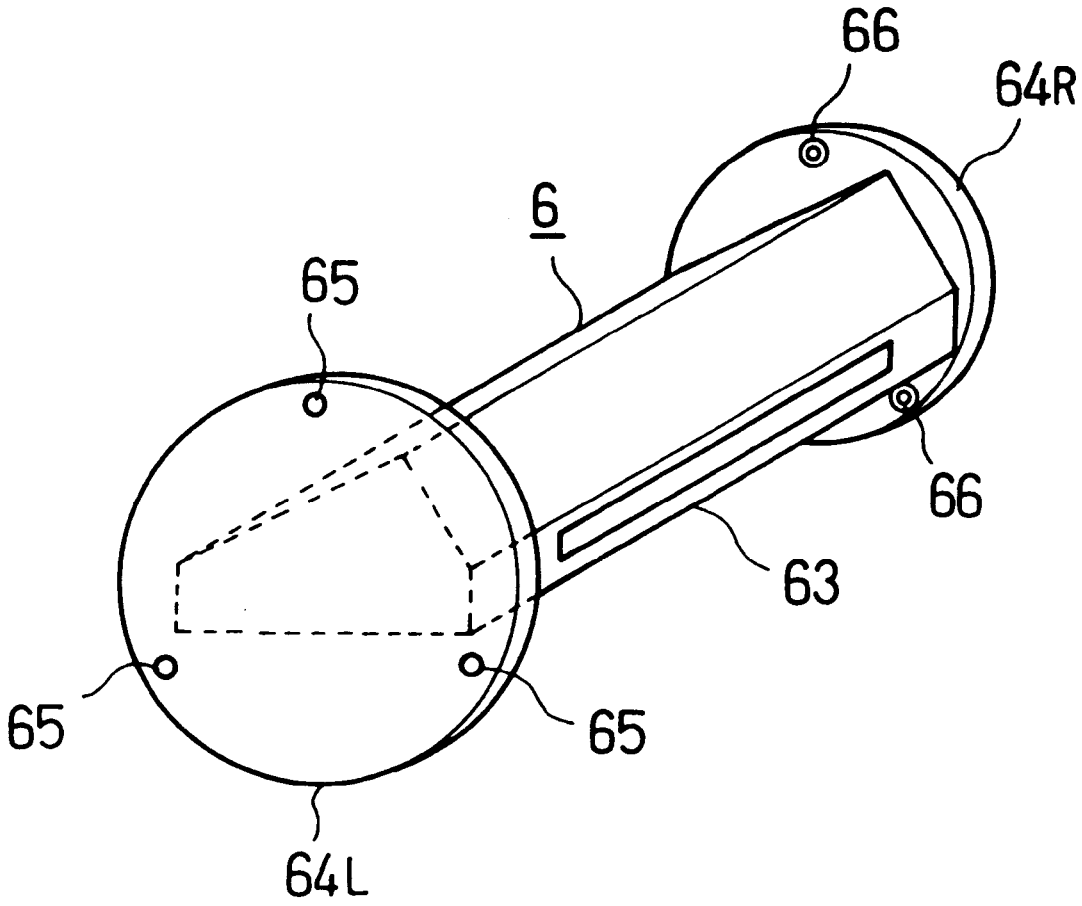
FIG. 4 is a perspective view showing an outside view of the laser exposing device.

FIG. 4 is an external view of the laser exposing device 6. Disk-shaped mounting plates 64R and 64L are attached to both sides of a laser exposing device main body 63. As can be seen from the sectional view in FIG. 3, a protrusion 67 for positioning is employed in the center of the mounting plate 64R. As is illustrated in FIG. 4, there are through holes 65 for holding screws in the mounting plate 64L and threaded holes 66 in the mounting plate 64R.

The laser exposing device 6 comprising the mounting plates 64R and 64L is inserted into the cylindrical shaft 21 from the left wall 1L of the main body and can be positioned by inserting the protrusion 67 into a hole provided in the middle of the bearing 46 attached to the right wall 1R. Then, it can be attached with screws using the through holes 65 and the threaded holes 66 of the left and right mounting plates 64 L and 64R. Therefore, the laser exposing device 6 usually maintains a stationary position regardless of the rotation of the carriage 2. The through holes in the main body corresponding to the through holes 65 and the threaded holes 66 can be long holes, so that a fine adjustment of the angle is possible by rotating the laser exposing device 6.

(Paper Feed System)

As is illustrated in FIG. 1, a mechanism for feeding and transporting recording paper comprises a paper feed unit 12, a paper feed roller 14, a paper ejection roller 18, and paper guides 13*a*, 13*b*, 13*c* and 13*d*.

(Mechanism for Driving and Positioning the Photosensitive Drum)

As is shown in FIGS. 2 and 3, a driving mechanism 60 of the photosensitive drum 30, which is attached on the right main wall 1R, includes an output shaft 70, a coupling plate 61 that rotates together with the output shaft 70, an output shaft driving gear 71, and a power source for driving these. The output shaft 70 is supported rotatably and displaceably in the axial direction by bearings 77 that are fixed to the right main wall 1R and to a base plate fixed in parallel thereto.

A tapered tip 75 formed on the distal end of the output shaft 70 has a convex tapered surface corresponding to a concave taper surface 48 formed on the right end of the shaft 40 of the photosensitive drum 30. The proximate end of the output shaft 70 has a spherical surface so as to abut on a thrust bearing 69 with little area. The output shaft driving gear 71, which is fixed to the output shaft 70, is a left-handed helical gear rotating in the same direction and engaging a gear 72 of the power source side.

A compression spring 74 is inserted between the bearing 77 and the output shaft driving gear 71. This spring 74 always applies a force to the output shaft 70 and the coupling plate 61 in the direction separating the coupling plate 61 of the output shaft 70 from the coupling plate 42 of the photosensitive drum 30. The gear 72 of the power source side has a sufficient length in the axial direction so that the output shaft gear 71 regularly engages the gear 72 of the power source side, even when the output shaft 70 is moved in the axial direction. When the output shaft 70 is moved in the axial direction, the output shaft drive gear 71 and the power source gear 72 slide against each other on their tooth faces.

Next, the detent mechanism 80, which is attached to the left main wall 1L, is explained. As is illustrated in FIG. 2, the detent mechanism 80 comprises a guide plate 81, a detent lever 82 and a plunger 85 for driving the detent lever 82. The guide plate 81 guides the collar 43 placed at the left end of the photosensitive drum shaft 40 in the vicinity of the image forming position 10 to position the collar 43 at a predetermined radial distance from the center of the carriage 2. The guide plate 81 is fixed to the left main wall 1L. The detent lever 82 is pivoted on the left main wall 1L by a pivot pin 83 and pushes the collar 43 to the guide plate 81 with a V-shaped cutout so as to position the collar 43 correctly in the image forming position. The detent lever 82 is connected to the plunger 85. The detent lever 82 is actuated by the plunger so that the V-shaped cutout of the detent lever 82 forces the collar 43 to abut the guide plate 81.

All parts are arranged so that the axis through the center of the output shaft 70 of the photosensitive drum driving mechanism 60 and the center of the V-shaped cutout of the detent mechanism 80 is precisely parallel to the axis of the laser exposing device 6. Clearances of the bearings are minimized. When the photosensitive drum driving mechanism 60 and the detent mechanism 80 are actuated, the image forming unit 30 is positioned with high precision at the image forming position 10.

(Main Driving Mechanism)

Figure 5:
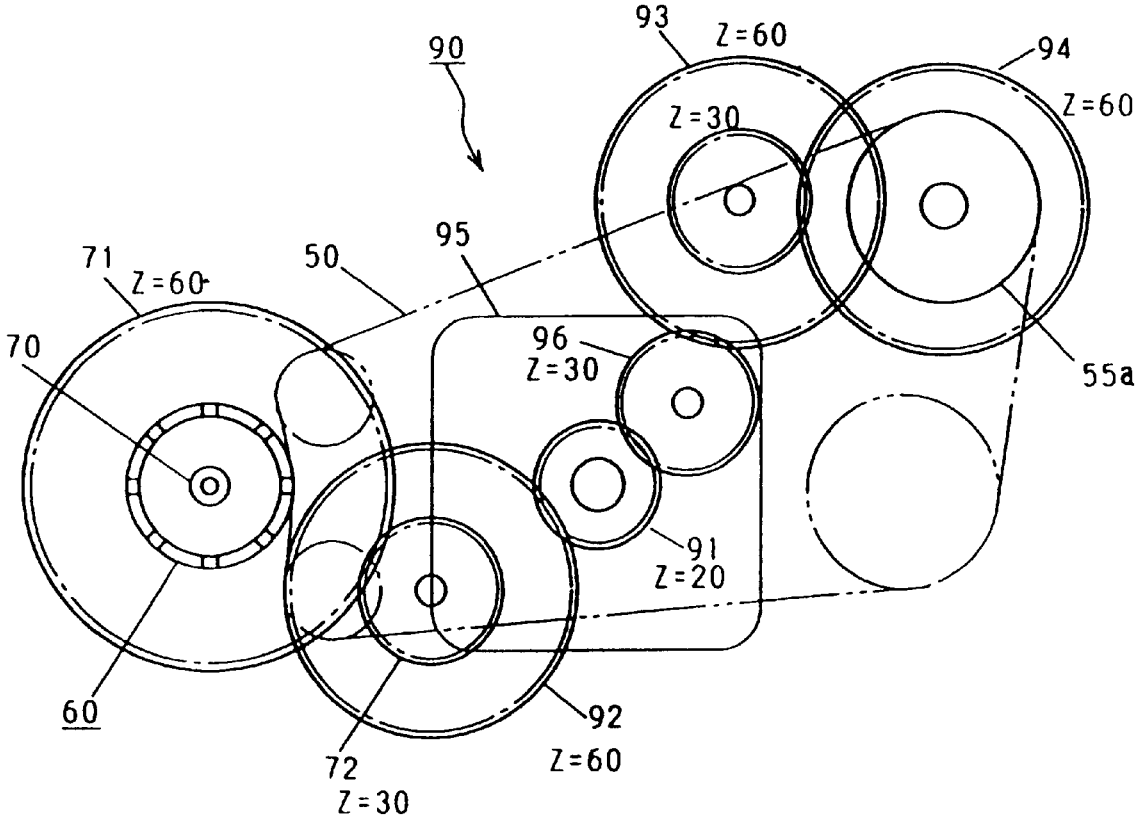
FIG. 5 is a drawing showing the power transmission of the driving mechanism, taken from the side of the machine body, that drives the photosensitive drum and the intermediate transfer belt.

Next, a driving mechanism driving the photosensitive drum 30 and the intermediate transfer belt 50 is explained. As is illustrated in FIG. 5, a driving mechanism 90 for the photosensitive drum and the intermediate transfer belt includes a first motor 95 as a power source and slowdown gears 92 and 93 that are connected to the first motor 95.

The slowdown gear 93 engages the pulley gear 94 fixed to the driving pulley 55*a*. The slowdown gear 92 engages the output shaft drive gear 71 to drive the photosensitive drum 30. A motor gear 91 engages the slowdown gear 92 and an idler gear 96. The rotation ratios among these gears are all integers.

The outer diameter of the drive pulley 55*a* is 30 mm, so that four turns of the drive pulley 55*a* corresponds to just one turn of the intermediate transfer belt 50 with its perimeter of 377 mm. The rotation ratio of the pulley gear 94, which is connected to the drive pulley 55*a*, to the slowdown gear 93 is 1:2, and that of the slowdown gear 93 to the motor gear 91 is 1:3. The outer diameter of the photosensitive drum 30 is also 30 mm. Four turns of the photosensitive drum 30 correspond to just one turn of the intermediate transfer belt 50, so that the photosensitive drum 30 is synchronized with the drive pulley 55*a*. The rotation ratio of the output shaft drive gear 71 to the slowdown gear 92 is 1:2, and that of the slowdown gear 92 to the motor gear 91 is 1:3. The outer diameter of the photosensitive drum 30, the outer diameter of the drive pulley 55*a* and the perimeter of the belt may be suitably adjusted to prevent misregistration, e.g. when the peripheral speed of the photosensitive drum 30 differs from the peripheral speed of the intermediate transfer belt 50 or when the peripheral speed of the intermediate transfer belt 50 differs due to variations of the belt thickness. Also in this case, the rotation ratios of the number of rotations of the drive pulley 55*a* and the photosensitive drum 30 per rotation of the intermediate transfer belt 50 are integers.

(Intermediate Transfer Belt and Photosensitive Drum)

Figure 6:
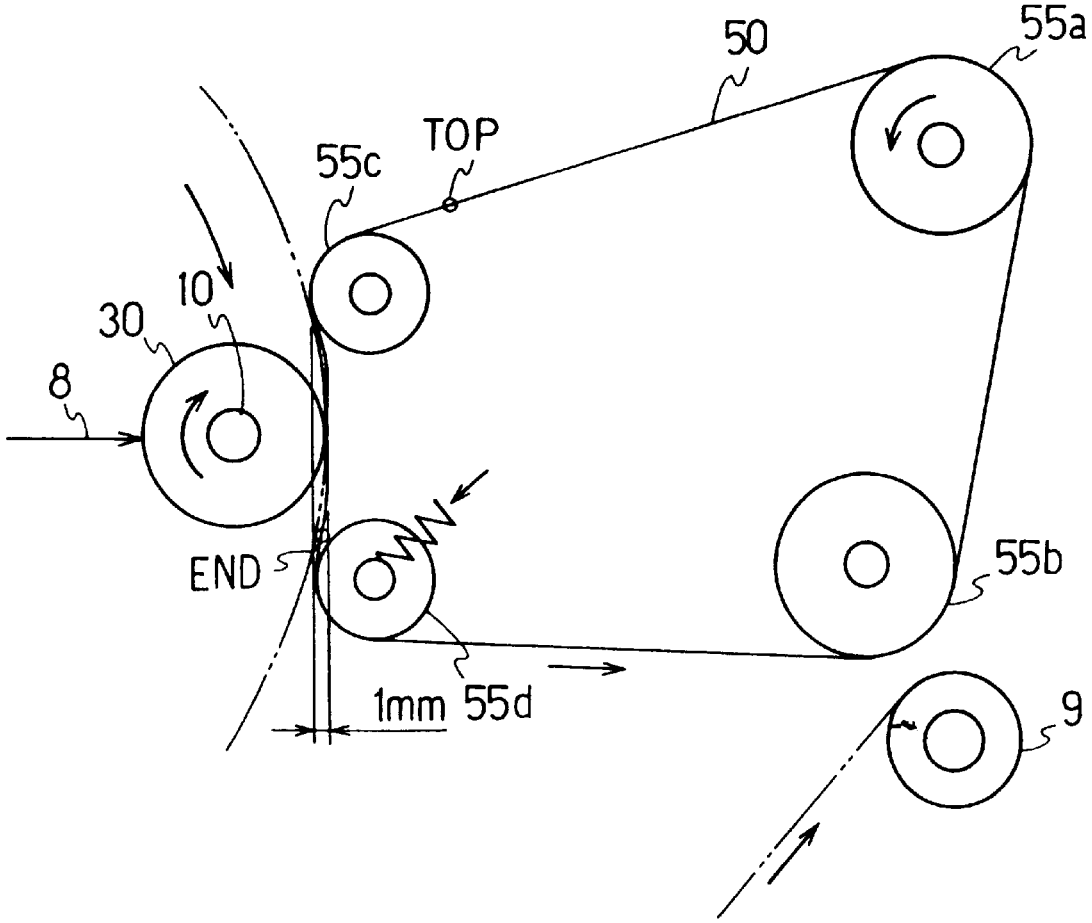
FIG. 6 is a drawing showing the positional relationship between the photosensitive drum of an image forming unit and the intermediate belt.
Figure 8:
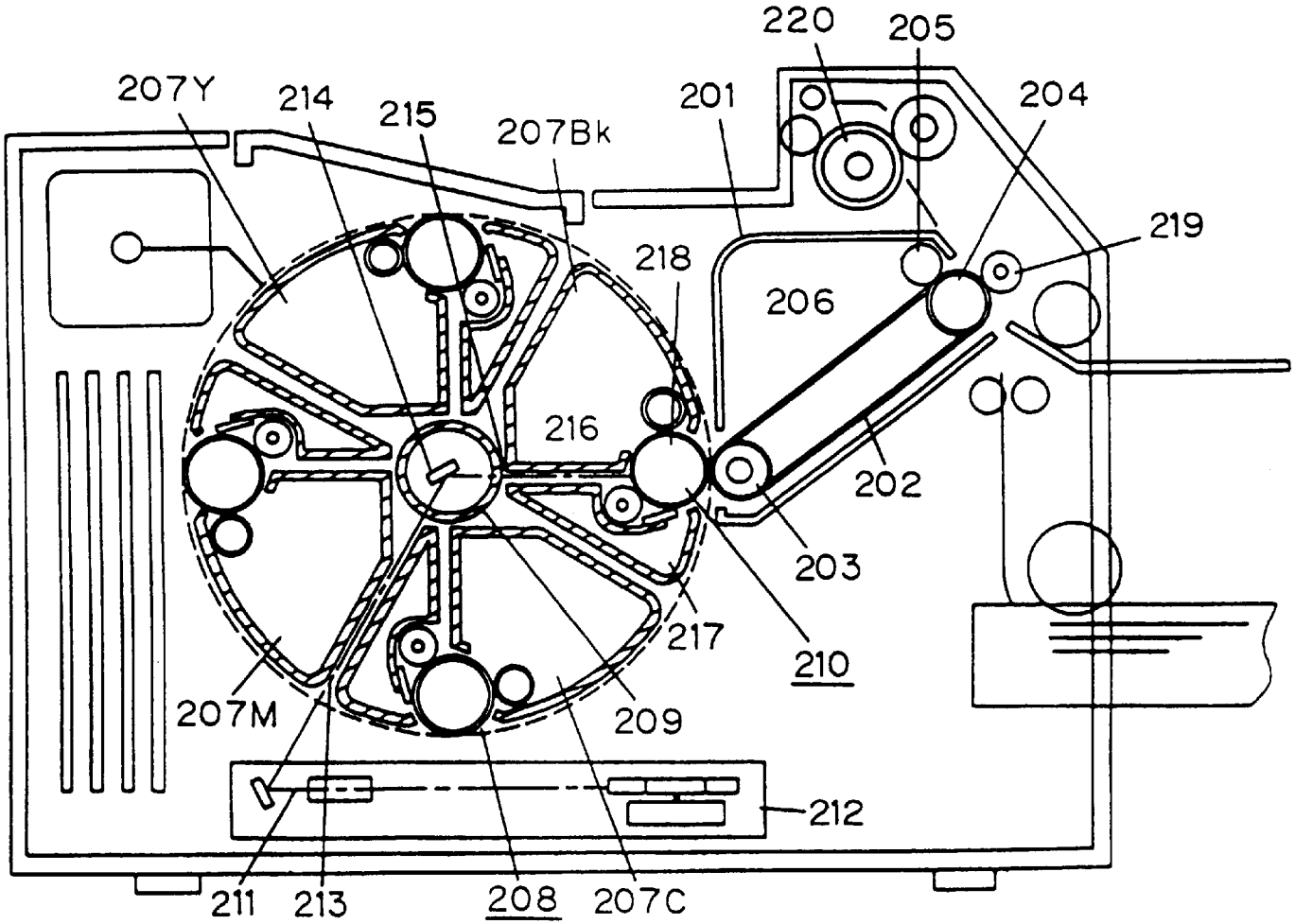
FIG 8 PRIOR ART
FIG. 8 is a sectional view showing the general structure of a conventional color image forming apparatus.

FIG. 6 illustrates the positional relationship between the photosensitive drum 30 located at the image forming position 10 and the intermediate transfer belt 50. When the transfer belt unit 5 is placed correctly between the right and left main walls 1L, 1R of the device main body, the perimeter of the photosensitive drum 30 positioned in the image forming position 10 crosses the tangent line of the guide roller 55*c* and the tension roller 55*d* by about one millimeter into the belt, as shown in FIG. 8. Therefore, the tension of the intermediate transfer belt 50 generates a constant pressure of the belt 50 against the peripheral surface of the photosensitive drum 30, so that uniform contact between the two is obtained. For example, a satisfactory performance for the image transfer was obtained by applying a spring force of about 2–3 kilograms onto the tension roller 55*d* in the direction indicated by the arrow in FIG. 8. In this example, the width of the intermediate transfer belt 50 was about 250 millimeters.

When the carriage 2 rotates for switching the image forming unit 3, the photosensitive drum 30 moves while rubbing the surface of the intermediate transfer belt 50. However, the intermediate transfer belt 50 rotates one turn per every image transfer for each color and usually stops in a position where an image-less region, in which no images are formed, touches the photosensitive drum 30. Therefore, no image distortion occurs due to the color change.

Next, the operation of the color image forming apparatus is explained. First of all, an example for the operation of the color image forming apparatus when a color image is output on one sheet is explained.

(Operation of the Entire Device)

In FIG. 1, the transfer belt unit 5 and all image forming units 3 are installed in their predetermined locations. When the power for the image forming apparatus 1 is turned on, a fixing device 15 is heated up, the polygon mirror 6*b* of the laser exposing device 6 starts to revolve and the preparations are terminated. Immediately after power-up, an initialization mode can be run to prepare the photosensitive drum 30 and the intermediate transfer belt 50.

When all preparations are finished, image formation with the yellow image forming unit 3Y begins. Because in the stand-by state usually the black image forming unit 3K is in the image forming position, the yellow image forming unit 3Y is moved into the image forming position 10 by a 90 degree rotation of the carriage 2. This means the motor for driving the carriage rotates and actuates the worm gear 89 in FIG. 2, so that the carriage 2 rotates in direction of the arrow shown in FIG. 1 and the yellow image forming unit 3Y is transported into the image forming position 10.

Then, the output shaft 70 of the photosensitive drum driving mechanism 60 retreats due to the energization of the compression spring 74, and the tapered tip 75 and the coupling plate 61 are in a position separated from the coupling plate 42 of the photosensitive drum. The plunger 85 of the detent mechanism 80 is in a turned-off condition and the detent lever 82 is also in a stand-by condition. The motor 95 driving the photosensitive drum and the intermediate transfer belt is standing still. The photosensitive drum 30 for yellow is transported while rubbing the surface of the intermediate transfer belt 50 and when this photosensitive drum 30 approaches the image forming position, the motor for driving the carriage stops, thereby stopping the worm gear 89, so that the carriage 2 is locked in this position.

When the carriage 2 stops, the plunger 85 is immediately turned on, so that the detent lever 82 forces the collar 43 of the photosensitive drum shaft 40 to abut the guide plate 81. A specified position is assumed by sandwiching the collar 43 between the V-shaped groove of the detent lever and the guide plate 81.

Simultaneously, the thrust bearing 69 counters the spring-force and pushes the output shaft 70 to the left in FIG. 3. When the tapered tip 75 of the output shaft 70 is pushed out, it starts to engage the concave tapered surface 48 of the photosensitive drum shaft 40 and it proceeds while adjusting the photosensitive drum shaft 40 to the center of the output shaft 70. The tapered tip 75 engages the concave tapered surface 48 and when the thrust bearing 69 further pushes the output shaft 70, the center of the photosensitive drum shaft 40 aligns perfectly with the center of the output shaft 70 and the photosensitive drum 30 is positioned precisely in the image forming position 10. Furthermore, when the tapered tip 75 engages the concave tapered surface 48, the coupling plates 42 and 61 engage each other, so that the rotational force of the output shaft 70 can be transmitted to the photosensitive drum 30.

When the positioning and coupling of the photosensitive drum are finished, the photosensitive drum and the motor 95 for driving the belt start to rotate, so that the photosensitive drum 30Y and the intermediate transfer belt 50 also start to rotate. When these members start to move, the developing device 35 and the corona charger 34 start to operate at the same time. The drive pulley 55*a* is actuated and the intermediate transfer belt 50 rotates due to friction forces in the direction indicated by an arrow in FIG. 1. At this time, the peripheral velocity of the photosensitive drum 30 becomes substantially the same as the peripheral velocity of the intermediate transfer belt 50. The secondary transfer roller 9 and the cleaning blade 53 are separated from the intermediate transfer belt 50.

The photosensitive drum and the intermediate transfer belt 50 assume a steady speed, and when the portion of the surface of the photosensitive drum 30 that is charged evenly by the corona charger 34 reaches the exposing position, a home position of the intermediate transfer belt 50 is detected and irradiation with the laser beam 8 from the laser exposing device 6 begins. When laser light modulated with the image signal is irradiated onto the evenly charged photosensitive drum 30, a static latent image is formed corresponding to the image signal. This static latent image is subsequently made manifest by the developing device 35 and turned into a toner image.

Then, the toner image formed on the photosensitive drum 30 is moved by rotation of the photosensitive drum 30 to a primary transfer position contacting the intermediate transfer belt 50, and is subsequently copied onto the intermediate transfer belt 50. This operation is continued for a A4-sized image. Meanwhile, the output shaft 70 is still pushed by the thrust bearing 69 to the left in FIG. 2, and the plunger 85 is still actuated, so that the detent lever retains the collar 43. When the end of the image has been copied onto the intermediate transfer belt 50, the yellow image formation is finished, and the photosensitive drum 30 and the intermediate transfer belt 50 stop due to interruption of the motor 95.

As the intermediate transfer belt 50 and the photosensitive drum 30 stop, the plunger 85 is turned off, thus releasing the detent and simultaneously causing the thrust bearing to retreat to the right in FIG. 2. As a result, the driving shaft 70 is withdrawn to the right by the restitutional force of the compression spring 74, and the coupling plate 61 and the tapered tip 75 are separated from the coupling plate 42 and the photosensitive drum shaft. Thus, the coupling is released and it becomes possible to rotate the carriage 2.

When the coupling is released, the worm gear 89 is again rotated, and the carriage 2 rotates in the direction indicated by an arrow in FIG. 2 to be stopped when the magenta image forming unit 3M for performing the next image formation has approached the image forming position 10. Again, the detent mechanism 80 and photosensitive drum driving mechanism 60 are actuated to perform positioning and coupling of the magenta photosensitive drum 30, while the motor 95 begins to rotate and the image formation of the second color, magenta, begins. As a result, a yellow and a magenta toner image are superimposed on the intermediate transfer belt 50.

The above operations are repeated for the third color, cyan, and the fourth color, black, so that a four-colored toner image is formed by superimposition on the intermediate transfer belt 50. After transcription of the last, black toner image, the secondary transfer roller 9 is moved by timing when the home position of the image reaches the position of the secondary transfer roller 9, and a recording paper sheet fed from the paper feed unit 12 is sandwiched between the secondary transfer roller 9 and the intermediate transfer belt 50. Thus, the four-colored toner image on the intermediate transfer belt 50 is transferred as a whole onto the recording paper sheet.

The recording paper onto which the toner image has been transferred passes through the fixing device 15 that fixes the toner image. Then, the paper sheet is ejected by the ejecting roller 18. The remaining toner on the intermediate transfer belt 50 is wiped off after the second transfer by the cleaning blade 53. The wiped toner is collected into the waste toner container 57 with a screw carrier 53*a*. When the second transfer is finished, the motor 95 rotates the intermediate transfer belt 50 into an initialization position and stops, thus terminating the color image formation. In one example, the time that it takes to rotate the carriage 2 for 90 degrees is about 0.6 sec, the time to attach or remove the coupling with the output shaft is about 0.2 sec, and the process speed was set to about 100 mm/sec.

Figure 7:
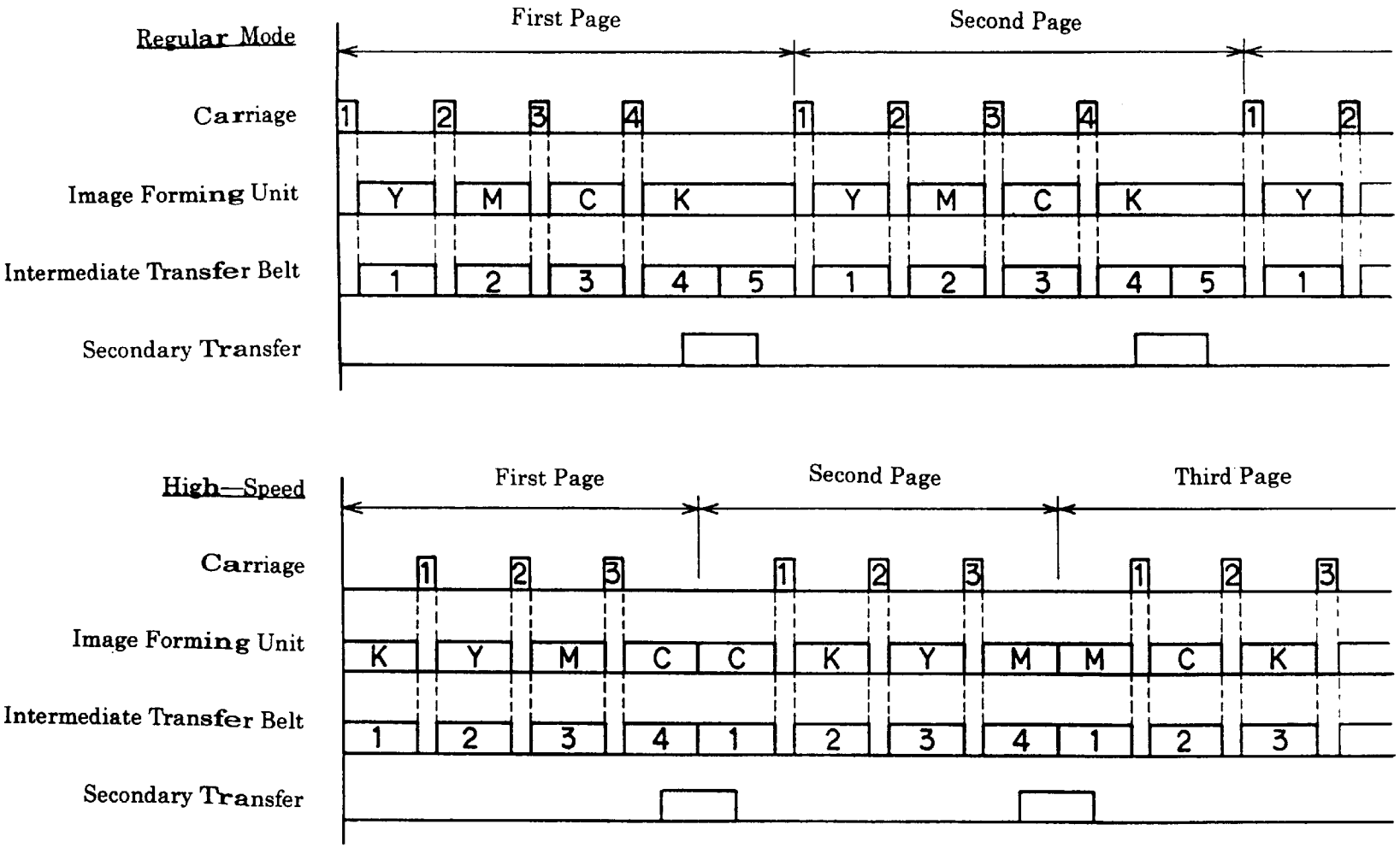
FIG. 7 is a time-chart showing a comparison of the regular mode and the high-speed mode of a color image forming apparatus according to the present invention.

Next, the operation for the case of continuous multiple image output is explained. In this case, the color image forming apparatus according to the present invention can be set to either a regular mode giving priority to image quality or a high-speed mode giving priority to output speed. FIG. 7 shows a time-chart comparing the regular mode to the high-speed mode.

(Regular Mode)

The operation for continuous output in the regular mode is basically a repetition of the operation for the case of output of one sheet as described above, that is, the order in which the colors of the toner image are superimposed on the intermediate transfer belt 50 is always the same, namely yellow (Y), magenta M), cyan (C) and finally black, as is shown in FIG. 7. Every time a toner image formation is finished, the image forming unit 3 (photosensitive drum 30, developing device 35, etc.) and the intermediate transfer belt 50 are stopped and the carriage is rotated 90 degrees to switch the image forming unit 3 in the image forming position.

In the formation of all toner images, for example, the surface of the photosensitive drum is charged to a constant potential of −500 V, and the potential of the portion that has been exposed by the laser beam is −50 V, so when the developing bias is a constant −170 V, the density of the toner image formed on the photosensitive drum will also be constant, corresponding to a constant potential difference of −120 V.

When the beginning of the image on the intermediate transfer belt 50 onto which the last, black toner image has been transferred reaches the secondary transfer position, the secondary transfer roller 9 pushes the recording paper sheet against the intermediate transfer belt 50 and the secondary transfer of the toner image onto the recording paper sheet begins. At the same time, the image forming process on the photosensitive drum 30 continues, and the primary transfer from the photosensitive drum 30 to the intermediate transfer belt 50 and the secondary transfer from the intermediate transfer belt 50 onto the recording paper sheet are performed simultaneously.

Regarding the black toner image, when the primary transfer from the photosensitive drum 30 to the intermediate transfer belt 50 is finished, the secondary transfer from the intermediate transfer belt 50 to the recording paper sheet still continues, so that the photosensitive drum 30 and the intermediate transfer belt 50 continue to rotate. This means, the intermediate transfer belt 50 rotates for a fifth time. Only, this time the laser beam does not irradiate the photosensitive drum, so that the photosensitive drum 30 and the developing device 35 perform a so-called "empty" rotation.

After the image end on the intermediate transfer belt 50 has passed the secondary transfer position and the secondary transfer is finished, the photosensitive drum 30 and the intermediate transfer belt 50 still continue to rotate, and the intermediate transfer belt 50 returns to the initialization position, after having rotated five times in total, and stops. Overall, for the recording of one color image, the carriage rotates four times for 90 degrees each and the intermediate transfer belt rotates five times Then, the detent and the coupling between the photosensitive drum 30 and the main body are released and the carriage 2 is rotated 90 degrees to begin the sequential image formation starting at yellow again. By repeating this operation, continuous image output can be performed. In this regular mode, four times the time needed to rotate the carriage 2 over 90 degrees for switching of the image forming unit plus the time to couple the photosensitive drum and five times the time to rotate the intermediate transfer belt 50 is needed for each color image output.

(High-Speed Mode)

In the following, the high-speed mode is explained, focusing on the differences with respect to the regular mode. As is shown in FIG. 7, the order by which the colors of the toner image are superimposed on the intermediate transfer belt 50 in the high-speed mode is not always the same, but starts with black (K) and ends with cyan (C) for the first sheet, and starts with cyan (C) and ends with magenta (M) for the second sheet. So whereas in the regular mode, each time, the carriage is first rotated 90 degrees to move the yellow (Y) image forming unit into the image forming position, in the high-speed mode, this operation is not performed, and the first toner image is formed using the image forming unit for the last color used in the preceding image formation. Because usually the black image forming unit is in the image forming position in the stand-by mode, the first image formation in the high-speed mode starts with black (K).

Moreover, in the high-speed recording mode, after the primary transfer of the last (cyan) toner image for the first page is finished, the home position of the fifth rotation of the intermediate transfer belt 50 is detected, and the laser exposing device 6 begins to irradiate the photosensitive drum with a laser beam corresponding to the cyan image data for the second page. Process elements such as the developing device continue their operation as well, so that the cyan image for the second page is copied onto the intermediate transfer belt 50.

Then, the secondary transfer of the first color image continues until the image end has passed the secondary transfer position. The cleaning operation also continues until the image end has passed, and these operations are executed simultaneously and in parallel. As can be seen in FIG. 7, the primary transfer of the last cyan image for the first page and the primary transfer of the first cyan image for the second page are performed in continuation, and the secondary transfer of the first sheet is performed in parallel thereto.

When the primary transfer of the cyan image for the second page is finished, the motor 95 stops to halt the photosensitive drum 30 and the intermediate transfer belt 50. Successively, the coupling between the photosensitive drum 30 and the driving mechanism is released, and the carriage 2 rotates 90 degrees to switch the image forming unit. The image forming unit for black (K) comes into the image forming position, and formation of the black (K) toner image and primary transfer onto the intermediate transfer belt 50 are performed.

Formation of the toner images for yellow (Y) and magenta (M) and primary transfer onto the intermediate transfer belt 50 are performed in the same manner, thus forming a four-colored image on the intermediate transfer belt 50. Even when the primary transfer of the fourth color magenta (M) is finished, the intermediate transfer belt 50 does not stop, and formation of the magenta (M) toner image for the third page and primary transfer are performed successively, while the secondary transfer of the color image for the second sheet is performed simultaneously in parallel thereto.

Thus, the order of color superimposition on the intermediate transfer belt 50 is K-Y-M-C for the first page, C-K-Y-M for the second page, and M-C-K-Y for the third page. In the following pages as well, the last color used for one image formation is the first color used in the following image formation. Thus, by changing the order of color superimposition in the high-speed mode, the intermediate transfer belt 50 rotates four times per color image output, and the carriage rotates 90 degrees for switching of the image forming unit three times per color image output, as is shown in FIG. 7. Therefore, compared to the regular mode described above, the time necessary for one rotation of the intermediate transfer belt plus the time necessary for once switching the carriage, coupling the photosensitive drum and starting and stopping the motor is saved, so that the speed for consecutive output is enhanced.

In the high-speed mode, the image forming unit that is in the image forming position when the last image output is terminated differs according to the number of output pages, but it is preferable that the black image forming unit is moved to the image forming position for preparation of the next output. This operation can be performed for example by actuating the carriage driving motor on the basis of sensor information detecting the rotational position of the carriage.

When the order of color superimposition changes as described above, the coloring may differ a little bit among the output color images. This difference usually poses no practical problem, but it is possible that small differences in the coloring of each page become a problem in the case of multiple output of the same image. In that case, it would be preferable to use the regular mode instead of the high-speed mode for image output. Because the order of color superimposition is always the same in the regular mode, variations in the coloring caused by the order of color superimposition do not occur.

In order to compensate coloring variations caused by changing the order of color superimposition in the high-speed mode, the process conditions for forming the toner image in each color can be regulated according to the order of color superimposition. That is, by controlling the process conditions of the toner image formations with the three colors other than black, among the colors that constitute the color image to be formed eventually on the recording paper sheet, the lower color toner images of the are set to be a little denser than the upper color toner images. When the color image formed on the intermediate transfer belt is copied as a whole onto recording paper in the secondary transfer, the order of the color layers constituting the color image on the recording paper is the reverse order from the order on the secondary transfer belt.

To be specific, the process conditions such as the developing bias and the charge potential of the photosensitive drum can be changed according to the order of color superimposition. For example, when the charge potential on the photosensitive drum surface is a constant −500 V, the potential of the portion exposed with the laser beam is −50 V, and the developing bias is a constant −170 V, then the density of the toner image formed on the photosensitive drum is constant according to a constant potential difference of 120 V.

However, if for example the developing bias for the toner image of the first color is set to −150 V, the developing bias for the toner image of the second color is set to −160 V, the developing bias for the toner image of the third color is set to −170 V, then the potential difference becomes 100 V, 110 V and 120 V, and thus sequentially bigger. As a result, the toner images become sequentially denser from the first color to the last color.

As has been pointed out above, the color that was formed first on the photosensitive drum becomes the uppermost color in the color image transferred as a whole onto recording paper in the secondary transfer, whereas the color that was formed last becomes the lowermost color. Therefore, according to the above process conditions, according to the above process conditions, the toner image for the lower colors is formed denser than the toner image for the upper colors. As a result, coloring variations due to the alteration of the order of color superimposition in the high-speed mode are compensated or reduced.

Explanations of an example for such a regulation of the process conditions have been omitted, but such a regulation can be easily achieved, for example with a microprocessor program. The used settings, such as for the developing bias, can be read out from pre-recorded process conditions (including e.g. the developing bias) according to the order of color superimposition (first, second, third layer, etc.).

In addition to the four-color mode, in which the color image is formed by superimposing toner images of four colors including black, a color image forming apparatus according to the present invention also has a three-color mode, in which the color image is formed only with the three colors yellow, magenta and cyan. In this three-color mode, by using a modified regulation of the above high-speed mode, the intermediate transfer belt 50 only rotates three times and the operation of switching the image forming unit is only performed two times per color image output, so that an even speedier output is possible.

In the case that consecutive output in the high-speed mode is performed in the three-color mode using only three color image forming units and not using the black image forming unit, the image formation on the first page is performed in the order yellow (Y)-magenta (M)-cyan (C). Recording on the second page begins with the last color of the first page, which is cyan (C), black (K) is skipped and then yellow (Y) and magenta (M) are formed. On the third page, the order is magenta (M)-cyan (C), then skip black (K), and use yellow (Y). Thus, the operations are performed in the same manner as for the high-speed mode described above, except that to switch from cyan (C) to yellow (Y), the carriage is rotated 180 degrees to skip black (K).

The present invention by no means is not limited to a color image forming apparatus comprising four image forming units, but can also be applied to an apparatus comprising three image forming units or an apparatus comprising five image forming units. When the high-speed mode is applied to these apparatus, the image forming unit is switched two times or four times respectively.

The unit structure of the laser exposing device shown in FIGS. 1 and 3 is only an example and a number of modifications to the specific structure of the laser exposing device to be contained as a unit within the cylinder shaped by the image forming units are possible.

Moreover, the present invention is not limited to a method wherein the toner images formed on the photosensitive drums are transferred as a whole onto recording paper, after they have been superimposed on the intermediate transfer belt, but can also be applied to an apparatus employing a method for direct synthesization of the color image on the recording paper, wherein a toner image is directly transferred from the photosensitive drums onto the recording paper. In this case, for example, the recording paper wound around the transfer drums corresponds to the transfer belt.

What is claimed is:

1. A color image forming apparatus wherein a plurality of image forming units, which correspond to a plurality of colors and comprise a developing device and a photosensitive drum, are arranged so as to define a cylinder, the color image forming apparatus comprising:

a conveying means for conveying said plurality of image forming units around a main axis of said cylinder between an image forming position and a waiting position by simultaneously rotating all image forming units;

an exposing device for exposure of the photosensitive drum of the image forming unit that is in said image forming position;

a transfer means, which contacts a transfer medium with the photosensitive drum of the image forming unit that is in said image forming position, and when the image forming unit that is in the image forming position is switched, successively transcribes the toner images of all colors formed on the photosensitive drums onto said transfer medium, superimposes the toner images of all colors and forms a colored toner image on said transfer medium; and a transfer medium driving means for driving said transfer medium at a constant speed; characterized in that when a first color image is formed, each time a toner image of one color is formed, said transfer medium driving means stops said transfer medium and said conveying means switches said image forming unit while said transfer medium is stopped;

when a second color image is formed after a first color image, said transfer medium driving means continues to drive said transfer medium; and the image formation continues while said conveying means is not moving but still retaining the image forming unit of the last color added to the first color image in the image forming position so that the first toner image color of the second color image is formed on said transfer medium by using the image forming unit of the last color added to the first color image.

2. The color image forming apparatus according to claim 1, wherein said transfer medium is an intermediate transfer medium transferring said colored toner image as a whole onto recording paper.

3. The color image forming apparatus according to claim 1, employing a regular mode, wherein, when the second color image is formed successively after formation of the first color image, the colors of the toner image are superimposed on said transfer medium in the same order as in the first color image by switching the image forming unit in the image forming position, and a high speed mode, wherein the toner image of the first color of the second color image is formed on said transfer medium by using the image forming unit of the last color that was superimposed in the first color image.

4. The color image forming apparatus according to claim 1, wherein, for the formation of the colors of the toner image, one from a plurality of stored process conditions is selected according to the order of color superimposition and executed.

5. The color image forming apparatus according to claim 1, employing a regular color mode using the four colors yellow, magenta, cyan and black for formation of a color image, and a three-color mode using the three colors yellow, magenta and cyan for formation of a color image.

6. A color image forming apparatus wherein a plurality of image forming units, which correspond to a plurality of colors and comprise a developing device and a photosensitive drum, are arranged so as to define a cylinder, the color image forming apparatus comprising:

a conveying means for conveying said plurality of image forming units around a main axis of said cylinder between an image forming position and a waiting position by simultaneously rotating all image forming units;

an exposing device for exposure of the photosensitive drum of the image forming unit that is in said image forming position;

a transfer means, which contacts a transfer medium with the photosensitive drum of the image forming unit that is in said image forming position, and when the image forming unit that is in the image forming position is switched, successively transcribes the toner images of all colors formed on the photosensitive drums onto said transfer medium, superimposes the toner images of all colors and forms a colored toner image on said transfer medium; and a transfer medium driving means for driving said transfer medium at a constant speed, characterized in that said exposing device comprising a light source is accommodated by the inner portion of the cylinder defined by said plurality of image forming units.

7. The color image forming apparatus according to claim 6, wherein said exposing device is a laser exposing device comprising a semiconductor laser as a light source.

8. The color image forming apparatus according to claim 6, wherein said exposing device is supported by plates on both sides of the device's main body opposing both ends of said cylinder, and said exposing device can be attached and removed in substantially a vertical direction from one of these plates.

9. The color image forming apparatus according to claim 6, comprising a positioning means for positioning both ends of the photosensitive drum in said image forming position, said exposing device and said positioning means being supported by plates on both sides of the device's main body opposing both ends of said cylinder.

10. The color image forming apparatus according to claim 6, wherein said conveying means comprises a carriage, which supports said plurality of image forming units and is rotatably supported by the device's main body, and a carriage driving mechanism for rotating the carriage.

11. The color image forming apparatus according to claim 10, wherein said image forming units comprise a photosensitive drum, a developing device for developing a latent image formed on a surface of said photosensitive drum, a toner hopper containing toner, a cleaner for removal of waste toner that remained on the surface of said photosensitive drum, a waste toner case for collection of waste toner that has been removed by said cleaner, wherein, in two adjacent image forming units supported by said carriage, the toner hopper of one image forming unit and the waste toner case of the other image forming unit are separated by a small spacing and face each other.

12. A color image forming method, wherein image forming units for a plurality of colors are moved successively into an image forming position by simultaneous rotation of the image forming units, which are arranged in a cylindrical arrangement, and a toner image formed on a photosensitive drum of the image forming unit in the image forming position is sequentially transferred to a transfer medium, so that a color toner image is formed on the transfer medium by superimposition of toner images of all colors, characterized in that during the formation of one color image, each time a toner image of one color is formed, said transfer medium stops and the image forming unit in the image forming position is switched while said transfer medium is stopped, but when moving from the formation of the first color image to the second color image, the movement of the transfer medium continues, and the formation of the second color image continues while the image forming unit is still being retained in the image forming position so that the toner image for the first color of the second color image is formed on said transfer medium by using the image forming unit of the last color added to the first color image.

13. The color image forming method according to claim 12, further comprising a step of transferring as a whole onto recording paper a color image formed onto the transfer medium.

14. A color image forming apparatus wherein a plurality of image forming units, which correspond to a plurality of colors and comprise a developing device and a photosensitive drum, are arranged so as to define a cylinder, the color image forming apparatus comprising:

a conveying means for conveying said plurality of image forming units around a main axis of said cylinder between an image forming position and a waiting position by simultaneously rotating all image forming units in a certain direction;

an exposing device for exposure of the photosensitive drum of the image forming unit that is in said image forming position;

a transfer means, which contacts a transfer medium with the photosensitive drum of the image forming unit that is in said image forming position, and when the image forming unit that is in the image forming position is switched, successively transcribes the toner images of all colors formed on the photosensitive drums onto said transfer medium, superimposes the toner images of all colors and forms a colored toner image on said transfer medium; and a transfer medium driving means for driving said transfer medium at a constant speed; wherein when a second color image is formed after a first color image, the image formation continues while the image forming unit of the last color added to the first color image is still retained in the image forming position so that the first toner image color of the second color image is formed on said transfer medium by using the image forming unit of the last color added to the first color image, and then, said image forming units are rotated in said certain direction, a next image forming unit is positioned in the image forming position, and the next color of the toner image is formed on said transfer medium.

15. The color image forming apparatus according to claim 14, wherein said transfer medium is an intermediate transfer medium transferring said colored toner image as a whole onto recording paper.

16. The color image forming apparatus according to claim 14, employing a regular mode, wherein, when the second color image is formed successively after formation of the first color image, the colors of the toner image are superimposed on said transfer medium in the same order as in the first color image by switching the image forming unit in the image forming position, and a high speed mode, wherein the toner image of the first color of the second color image is formed on said transfer medium by using the image forming unit of the last color that was superimposed in the first color image.

17. The color image forming apparatus according to claim 14, wherein, for the formation of the colors of the toner image, one from a plurality of stored process conditions is selected according to the order of color superimposition and executed.

18. The color image forming apparatus according to claim 14, employing a regular color mode using the four colors yellow, magenta, cyan and black for formation of a color image, and a three-color mode using the three colors yellow, magenta and cyan for formation of a color image.

19. A color image forming apparatus wherein a plurality of image forming units, which correspond to a plurality of colors and comprise a developing device and a photosensitive drum, are arranged so as to define a cylinder, the color image forming apparatus comprising:

a conveying means for conveying said plurality of image forming units around a main axis of said cylinder between an image forming position and a waiting position by simultaneously rotating all image forming units;

an exposing device for exposure of the photosensitive drum of the image forming unit that is in said image forming position;

a transfer means, which contacts a transfer medium with the photosensitive drum of the image forming unit that is in said image forming position, and when the image forming unit that is in the image forming position is switched, successively transcribes the toner images of all colors formed on the photosensitive drums onto said transfer medium, superimposes the toner images of all colors and forms a colored toner image on said transfer medium; and a transfer medium driving means for driving said transfer medium at a constant speed; wherein when a second color image is formed after a first color image, the image formation continues while the image forming unit of the last color added to the first color image is still retained in the image forming position so that the first toner image color of the second color image is formed on said transfer medium by using the image forming unit of the last color added to the first color image, and then, said image forming units are rotated, a next image forming unit is positioned in the image forming position, and the next color of the toner image is formed on said transfer medium, so that a concentration is denser than in the first toner image of the second color image.

20. The color image forming apparatus according to claim 19, wherein said transfer medium is an intermediate transfer medium transferring said colored toner image as a whole onto recording paper.

21. The color image forming apparatus according to claim 19, employing a regular mode, wherein, when the second color image is formed successively after formation of the first color image, the colors of the toner image are superimposed on said transfer medium in the same order as in the first color image by switching the image forming unit in the image forming position, and a high speed mode, wherein the toner image of the first color of the second color image is formed on said transfer medium by using the image forming unit of the last color that was superimposed in the first color image.

22. The color image forming apparatus according to claim 19, wherein, for the formation of the colors of the toner image, one from a plurality of stored process conditions is selected according to the order of color superimposition and executed.

23. The color image forming apparatus according to claim 19, employing a regular color mode using the four colors yellow, magenta, cyan and black for formation of a color image, and a three-color mode using the three colors yellow, magenta and cyan for formation of a color image.

24. A color image forming apparatus retaining a plurality of image forming units corresponding to a plurality of colors and comprising a developing device and a photosensitive drum, the color image forming apparatus comprising:

a conveying means for conveying said plurality of image forming units between an image forming position and a waiting position by simultaneously moving all image forming units;

an exposing device for exposure of the photosensitive drum of the image forming unit that is in said image forming position;

a transfer means, which contacts a transfer medium with the photosensitive drum of the image forming unit that is in said image forming position, and when the image forming unit that is in the image forming position is switched, successively transcribes the toner images of all colors formed on the photosensitive drums onto said transfer medium, superimposes the toner images of all colors and forms a colored toner image on said transfer medium; and a transfer medium driving means for driving said transfer medium at a constant speed; wherein when a first color image is formed, each time a toner image of one color is formed, said transfer medium driving means stops said transfer medium and said conveying means switches said image forming unit while said transfer medium is stopped;

when a second color image is formed after a first color image, said transfer medium driving means continues to drive said transfer medium; and the image formation continues while said conveying means is not moving but still retaining the image forming unit of the last color added to the first color image in the image forming position so that the first toner image color of the second color image is formed on said transfer medium by using the image forming unit of the last color added to the first color image.

25. The color image forming apparatus according to claim 24, wherein said transfer medium is an intermediate transfer medium transferring said colored toner image as a whole onto recording paper.

26. The color image forming apparatus according to claim 24, employing a regular mode, wherein, when the second color image is formed successively after formation of the first color image, the colors of the toner image are superimposed on said transfer medium in the same order as in the first color image by switching the image forming unit in the image forming position, and a high speed mode, wherein the toner image of the first color of the second color image is formed on said transfer medium by using the image forming unit of the last color that was superimposed in the first color image.

27. The color image forming apparatus according to claim 24, wherein, for the formation of the colors of the toner image, one from a plurality of stored process conditions is selected according to the order of color superimposition and executed.

28. The color image forming apparatus according to claim 24, employing a regular color mode using the four colors yellow, magenta, cyan and black for formation of a color image, and a three-color mode using the three colors yellow, magenta and cyan for formation of a color image.

29. A color image forming method, wherein image forming units for a plurality of colors are moved successively into an image forming position by simultaneous rotation in a certain direction of the image forming units, which are arranged in a cylindrical arrangement, and a toner image formed on a photosensitive drum of the image forming unit in the image forming position is sequentially transferred to a transfer medium, so that a color toner image is formed on the transfer medium by superimposition of toner images of all colors, characterized in that when a second color image is formed after a first color image, the image formation continues while the image forming unit of the last color added to the first color image is still retained in the image forming position so that the first toner image color of the second color image is formed on said transfer medium by using the image forming unit of the last color added to the first color image, and then, said image forming units are rotated in said certain direction, a next image forming unit is positioned in the image forming position, and the next color of the toner image is formed on said transfer medium.

30. The color image forming method according to claim 29, further comprising a step of transferring as a whole onto recording paper a color image formed on the transfer medium.

31. A color image forming method, wherein image forming units for a plurality of colors are moved successively into an image forming position by simultaneous rotation of the image forming units, which are arranged in a cylindrical arrangement, and a toner image formed on a photosensitive drum of the image forming unit in the image forming position is sequentially transferred to a transfer medium, so that a color toner image is formed on the transfer medium by superimposition of toner images of all colors, characterized in that when a second color image is formed after a first color image, the image formation continues while the image forming unit of the last color added to the first color image is still retained in the image forming position so that the first toner image color of the second color image is formed on said transfer medium by using the image forming unit of the last color added to the first color image, and then, said image forming units are rotated, a next image forming unit is positioned in the image forming position, and the next color of the toner image is formed on said transfer medium, so that a concentration is denser than in the first toner image of the second color image.

32. The color image forming method according to claim 31, further comprising a step of transferring as a whole onto recording paper a color image formed on the transfer medium.

33. A color image forming method, wherein image forming units for a plurality of colors are moved between an image forming position and a waiting position by simultaneously moving the image forming units, and a toner image formed on a photosensitive drum of the image forming unit in the image forming position is sequentially transferred to a transfer medium, so that a color toner image is formed on the transfer medium by superimposition of toner images of all colors, characterized in that when a first color image is formed, each time a toner image of one color is formed, said transfer medium stops and the image forming unit in the image forming position is switched while said transfer medium is stopped, and when a second color image is formed after the first color image, the transfer medium continues to move and the formation of the second color image continues while the image forming unit of the last color added to the first color image is still retained in the image forming position so that the first toner image color of the second color image is formed on said transfer medium by using the image forming unit of the last color added to the first color image.

34. The color image forming method according to claim 33, further comprising a step of transferring as a whole onto recording paper a color image formed on the transfer medium.

35. A color image forming apparatus retaining a plurality of image forming units corresponding to a plurality of colors and comprising a developing device and a photosensitive drum, the color image forming apparatus comprising:

a conveying means for conveying said plurality of image forming units between an image forming position and a waiting position by simultaneously moving all image forming units;

an exposing device for exposure of the photosensitive drum of the image forming unit that is in said image forming position;

a transfer means, which contacts a transfer medium with the photosensitive drum of the image forming unit that is in said image forming position, and when the image forming unit that is in the image forming position is switched, successively transcribes the toner images of all colors formed on the photosensitive drums onto said transfer medium, superimposes the toner images of all colors and forms a colored toner image on said transfer medium; and a transfer medium driving means for driving said transfer medium at a constant speed; wherein when a second color image is formed after a first color image, the image formation continues while the image forming unit of the last color added to the first color image is still retained in the image forming position so that the first toner image color of the second color image is formed on said transfer medium by using the image forming unit of the last color added to the first color image, and then, said image forming units are moved, a next image forming unit is positioned in the image forming position, and the next color of the toner image is formed on said transfer medium.

36. A color image forming method, wherein image forming units for a plurality of colors are moved between an image forming position and a waiting position by simultaneously moving the image forming units, and a toner image formed on a photosensitive drum of the image forming unit in the image forming position is sequentially transferred to a transfer medium, so that a color toner image is formed on the transfer medium by superimposition of toner images of all colors, characterized in that when a second color image is formed after a first color image, the image formation continues while the image forming unit of the last color added to the first color image is still retained in the image forming position so that the first toner image color of the second color image is formed on said transfer medium by using the image forming unit of the last color added to the first color image, and then, said image forming units are moved, a next image forming unit is positioned in the image forming position, and the next color of the toner image is formed on said transfer medium.

37. A color image forming apparatus retaining a plurality of image forming units corresponding to a plurality of colors and comprising a developing device and a photosensitive drum, the color image forming apparatus comprising:

a conveying means for conveying said plurality of image forming units between an image forming position and a waiting position by simultaneously moving all image forming units;

an exposing device for exposure of the photosensitive drum of the image forming unit that is in said image forming position;

a transfer means, which contacts a transfer medium with the photosensitive drum of the image forming unit that is in said image forming position, and when the image forming unit that is in the image forming position is switched, successively transcribes the toner images of all colors formed on the photosensitive drums onto said transfer medium, superimposes the toner images of all colors and forms a colored toner image on said transfer medium; and a transfer medium driving means for driving said transfer medium at a constant speed; wherein when a second color image is formed after a first color image, the image formation continues while the image forming unit of the last color added to the first color image is still retained in the image forming position so that the first toner image color of the second color image is formed on said transfer medium by using the image forming unit of the last color added to the first color image, and then, said image forming units are moved, a next image forming unit is positioned in the image forming position, and the next color of the toner image is formed on said transfer medium, so that a concentration is denser than in the first toner image of the second color image.

38. A color image forming method, wherein image forming units for a plurality of colors are moved between an image forming position and a waiting position by simultaneously moving the image forming units, and a toner image formed on a photosensitive drum of the image forming unit in the image forming position is sequentially transferred to a transfer medium, so that a color toner image is formed on the transfer medium by superimposition of toner images of all colors, characterized in that when a second color image is formed after a first color image, the image formation continues while the image forming unit of the last color added to the first color image is still retained in the image forming position so that the first toner image color of the second color image is formed on said transfer medium by using the image forming unit of the last color added to the first color image, and then, said image forming units are moved, a next image forming unit is positioned in the image forming position, and the next color of the toner image is formed on said transfer medium, so that a concentration is denser than in the first toner image of the second color image.

* * * * *